US008678098B2

(12) United States Patent
Soni et al.

(10) Patent No.: US 8,678,098 B2
(45) Date of Patent: Mar. 25, 2014

(54) MAGNETICALLY COUPLED ACTUATION APPARATUS AND METHOD

(75) Inventors: Mohan L. Soni, Katy, TX (US); Gaurav Agrawal, Aurora, CO (US)

(73) Assignee: Baker Hughes Incorporated, Houston, TX (US)

( * ) Notice: Subject to any disclaimer, the term of this patent is extended or adjusted under 35 U.S.C. 154(b) by 312 days.

(21) Appl. No.: 12/945,247

(22) Filed: Nov. 12, 2010

(65) Prior Publication Data

US 2012/0118582 A1 May 17, 2012

(51) Int. Cl.
*E21B 23/00* (2006.01)

(52) U.S. Cl.
USPC ..... 166/386; 166/318; 166/66.5

(58) Field of Classification Search
USPC ..... 166/386, 318, 332.4, 66.5
See application file for complete search history.

(56) References Cited

U.S. PATENT DOCUMENTS

| | | | | |
|---|---|---|---|---|
| 3,086,589 | A * | 4/1963 | McGowen, Jr. | 166/65.1 |
| 4,448,427 | A | 5/1984 | Mashaw, Jr. | |
| 6,848,511 | B1 | 2/2005 | Jones et al. | |
| 6,915,848 | B2 * | 7/2005 | Thomeer et al. | 166/250.11 |
| 7,673,677 | B2 | 3/2010 | King et al. | |
| 2002/0162661 | A1 | 11/2002 | Krauss et al. | |
| 2003/0151522 | A1 | 8/2003 | Jeffryes et al. | |
| 2004/0118564 | A1 | 6/2004 | Themig et al. | |
| 2004/0163820 | A1 | 8/2004 | Bishop et al. | |
| 2004/0245016 | A1 | 12/2004 | Chemali et al. | |
| 2007/0289734 | A1 | 12/2007 | McDonald et al. | |
| 2007/0295507 | A1 | 12/2007 | Telfer et al. | |
| 2008/0019217 | A1 | 1/2008 | Gluszyk | |
| 2009/0044948 | A1 | 2/2009 | Avant et al. | |
| 2009/0302982 | A1 | 12/2009 | Putman et al. | |
| 2010/0032155 | A1 | 2/2010 | Darnell et al. | |

OTHER PUBLICATIONS

Notification of Transmittal of the International Search Report and the Written Opinion of the International Searching Authority, or the Declaration; PCT/US2011/060171; Jun. 25, 2012.

Notification of Transmittal of the International Search Report and the Written Opinion of the International Searching Authority, or the Declaration; PCT/US2011/043039; Feb. 23, 2012.

K.L. Decker, "Computer Modeling of Gas-Lift Performance"; Offshore Technology Conference, May 5-8, 1986; Paper No. 5246.

Gudmund Engen et al., "Reliability of Downhole Safety Valves Used in the North Sea"; 1982 Offshore Technology Conference; May 3-6, 1992; Paper No. OTC 4355.

F.J. Garver et al., "The Competition for Chromium Between Xanthan Biopolymer and Resident Clays in Standstones"; Society of Petroleum Engineers; Paper No. 19632; 54th Annual Technical Conference and Exhibition; San Antonio, TX, Oct. 8-11, 1989.

(Continued)

*Primary Examiner* — David Andrews
(74) *Attorney, Agent, or Firm* — Cantor Colburn LLP

(57) ABSTRACT

An actuator includes: a carrier including an axially elongated fluid conduit therein, the fluid conduit configured to received a ball therein; and an axially elongated ball receiving element, wherein one of the ball and the ball receiving element is configured to produce a magnetic field, and another of the ball and the ball receiving element includes an electrically conductive material, the ball and the ball receiving element configured so that the electrically conductive material is exposed to the magnetic field as the ball advances through the ball receiving element, and eddy currents are generated in the electrically conductive material that cause a repulsive force between the ball receiving element and the ball to at least one of reduce a velocity of the ball and actuate the ball receiving element.

20 Claims, 4 Drawing Sheets

(56) References Cited

OTHER PUBLICATIONS

Levin, et al. "Electromagnetic braking: A simple quantitative model". AM. J. Phys. 74(9), Sep. 2006. pp. 815-817.

R.A. Skopec et al., "Recent Advances in Coring Technology: New Techniques to Enhance Reservoir Evaluation and Improve Coring Economics"; 1996 SCA Conference Paper No. 9604; Society of Core Analysts; Annual Meeting, Montpellier France, Sep. 8-10, 1996.

* cited by examiner

MAGNETICALLY COUPLED ACTUATION APPARATUS AND METHOD

BACKGROUND

In the drilling and completion industry and for example in hydrocarbon exploration and recovery operations, a variety of components and tools are lowered into a borehole for various operations such as production operations, for example. Some downhole tools utilize ball-seat assemblies to act as a valve or actuator. Ball-seat assemblies are used with, for example, hydraulic disconnects, circulating subs and inflatable packers.

Actuation of a ball-seat assembly generally includes releasing a ball or other plug into a fluid conduit and allowing the ball to drop onto the ball seat and restrict fluid flow therein. The impact between the ball and the ball seat can produce pressure waves, which can cause wear and/or damage to components of the assembly.

SUMMARY

An actuator includes: a carrier including an axially elongated fluid conduit therein, the fluid conduit configured to received a ball therein; and an axially elongated ball receiving element, wherein one of the ball and the ball receiving element is configured to produce a magnetic field, and another of the ball and the ball receiving element includes an electrically conductive material, the ball and the ball receiving element configured so that the electrically conductive material is exposed to the magnetic field as the ball advances through the ball receiving element, and eddy currents are generated in the electrically conductive material that cause a repulsive force between the ball receiving element and the ball to at least one of reduce a velocity of the ball and actuate the ball receiving element.

A method of actuating includes: releasing a ball into a fluid conduit in a carrier and receiving the ball in an axially elongated ball receiving element disposed at the fluid conduit, wherein one of the ball and the ball receiving element is configured to produce a magnetic field, and another of the ball and the ball receiving element includes an electrically conductive material; advancing the ball through the ball receiving element so that the electrically conductive material is exposed to the magnetic field as the ball advances through the ball receiving element; and producing a repulsive force between the ball receiving element and the ball via eddy currents generated in the electrically conductive material, the repulsive force causing at least one of a reduction in a velocity of the ball and an actuation of the ball receiving element.

BRIEF DESCRIPTION OF THE DRAWINGS

The following descriptions should not be considered limiting in any way. With reference to the accompanying drawings, like elements are numbered alike.

DETAILED DESCRIPTION

The apparatuses, systems and methods described herein provide for reducing or eliminating an impact between a ball and a ball receiving element such as a ball seat, and for the mitigation of pressure waves caused by actuation of a ball-seat assembly. A downhole assembly includes a conduit having a longitudinal component to guide a ball released into the conduit to a receiving element such as an actuating sleeve or a ball seat. The ball includes a magnetized material and produces a magnetic field, and at least a portion of the conduit is sufficiently electrically conductive so that eddy currents are created in the conduit material when the ball moves through the conductor portion. The eddy currents produce a magnetic field that opposes the magnetic field of the ball and impedes the ball's motion, thereby slowing the descent of the ball and reducing the impact of the ball and the ball seat and/or allowing actuation of the ball seat assembly without requiring direct contact between the ball and the ball seat.

Figure 1:
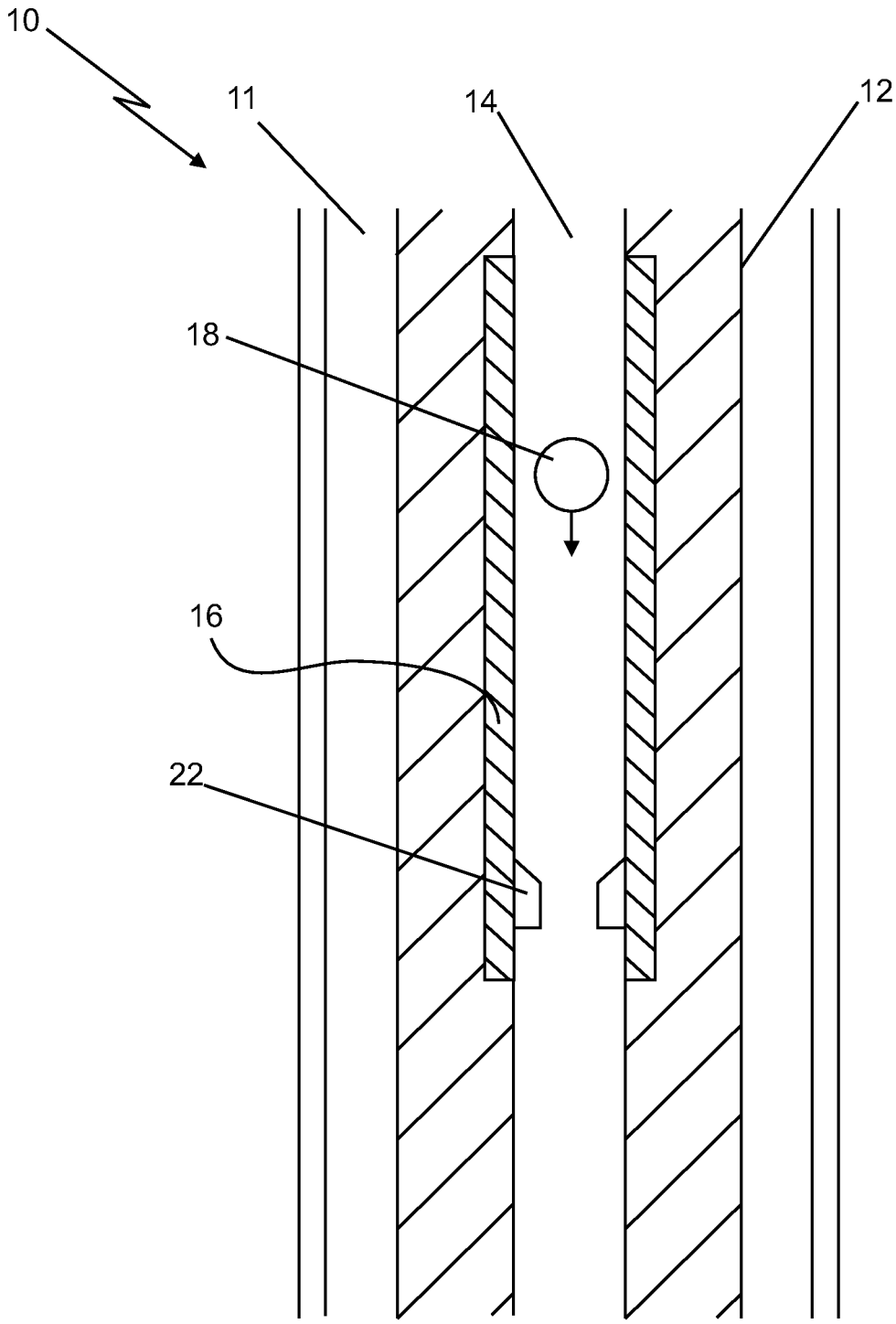
FIG. 1 is a cross-sectional view of an embodiment of a downhole tool including an actuation assembly.

Referring to FIG. 1, a downhole tool 10, such as a ball seat sub, configured to be disposed in a borehole 11, includes a housing 12 or other carrier having a longitudinal bore or fluid conduit 14. The housing 12 includes an actuation assembly having an axially elongated receiving element or actuation region 16 made from an electrically conductive nonmagnetic material. In one embodiment, the electrically conductive actuation region 16 is made of a more conductive material than the housing 12. For example, the actuation region is made from copper or aluminum and the housing 12 is made from steel or stainless steel. The fluid conduit 14 and the actuation region are described herein as having cylindrical inner surfaces, although they may take any suitable shape and have any suitable cross-sectional area.

The actuation assembly also includes a movable magnetized actuator 18 that is configured to be moved along the actuation region 16 to actuate the assembly. In one embodiment, the actuator 18 is a spherical metal or plastic plug, referred to as a ball 18, although "ball" may refer to any type of moveable or droppable plugging element, such as a cylindrical plug, a cylindrical or spherical magnet, and a drop plug, and may take any desired shape or size. Actuation of the assembly includes releasing the ball 18 into the fluid conduit 14, for example by dropping the ball 18 into and/or pumping the ball 18 through the fluid conduit 14 from a surface or downhole location. The ball 18 falls and/or is advanced axially downstream by downhole fluid and advances through the conductive region 16. The moving ball 18 applies a moving magnetic field to the conductive region 16, which creates eddy currents in the region 16. The eddy currents in turn generate a magnetic field that opposes the ball's moving magnetic field and impedes the motion of the ball 18, i.e., slows the ball 18 down. The repulsive force caused by the interaction between the opposing magnetic fields is proportional to the velocity of the ball 18.

The magnetized ball 18 may be made out of any suitable ferromagnetic material, such as iron, cobalt and rare-earth metal alloys. Example of magnets include ceramic magnets and rare-earth magnets such as Neodymium magnets and Samarium-cobalt magnets. Any type of magnet or magnetic material may be used that retains its magnetization at downhole temperatures and produces a magnetic field strong enough to slow the velocity of the ball 18. The ball 18 may be made entirely of a magnetized material (as shown, for example, in FIG. 3) or may include a magnet 20 such as a permanent magnet embedded therein (as shown, for example, in FIG. 2) or otherwise attached to the ball 18. For example, the ball 18 may include a magnet embedded within an electrically non-conductive material such as a plastic material. Other examples of the magnet 20 include electromagnets such as a solenoid magnet, which may include an electric power source such as a battery disposed in the magnet 20 and/or the ball 18.

In one embodiment, the ball-seat assembly includes a ball seating element such as a ball seat 22 included in the conduit 14 and disposed on or near the actuation region 16 to retain the ball 18 after the ball 18 is released into the conduit 14. The ball seat 22 includes one or more components that radially extend into the fluid conduit 14. During actuation of the assembly, in one embodiment, the ball 18 advances toward and is seated on the ball seat 22 to restrict fluid flow through the conduit 14 and/or actuate the assembly. The ball seat 22 may be an annular component connected to the conduit 14, or any other device or configuration providing a restriction in the diameter or cross-sectional area of the conduit 14 sufficient to prevent the ball 22 from passing therethrough or at least impede the axial movement of the ball 18 as the ball passes therethrough. In one embodiment, the ball seat 22 is directly disposed on and/or attached to the inner surface of the conduit 14 or the actuation region 16 or is partially embedded therein.

The ball seat 22 described herein may be included in various configurations. For example, the ball seat 22 is a single annular component at least partially protruding into the conduit 14, or includes a plurality of circumferentially arrayed protrusions or members extending radially into the conduit 14. In one embodiment, the ball seat 22 includes multiple seating components 22 distributed axially to incrementally decelerate the ball 18.

Figure 2:
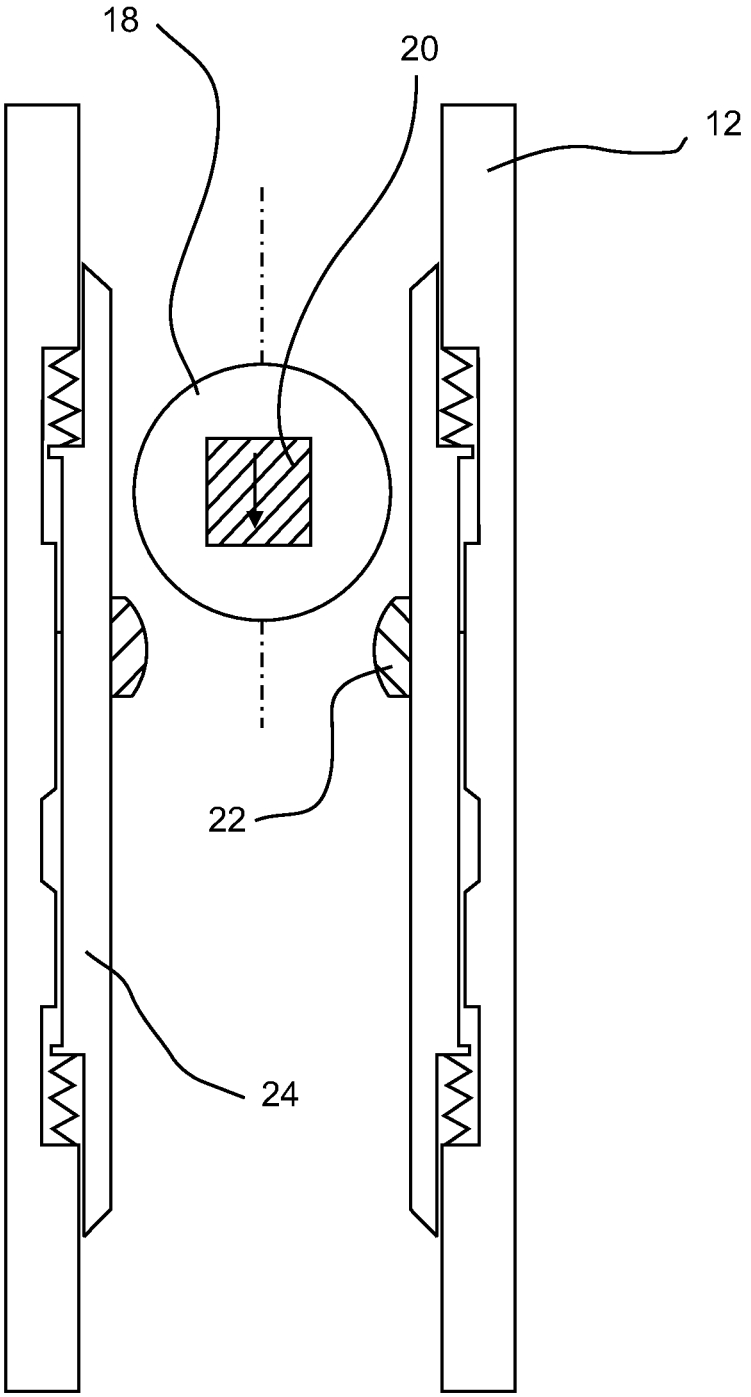
FIG. 2 is a cross-sectional view of an embodiment of the actuation assembly of FIG. 1.
Figure 3:
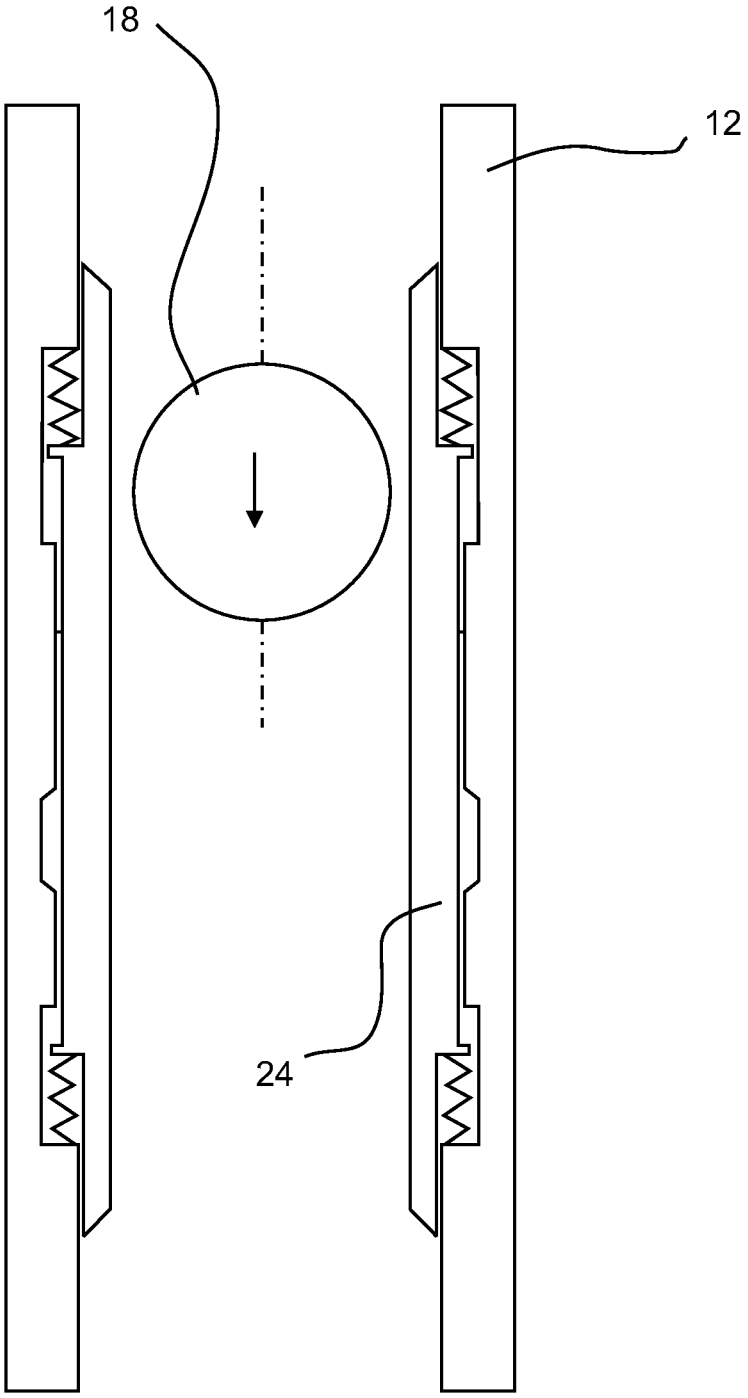
FIG. 3 is a cross-sectional view of an embodiment of the actuation assembly of FIG. 1.
Figure 4:
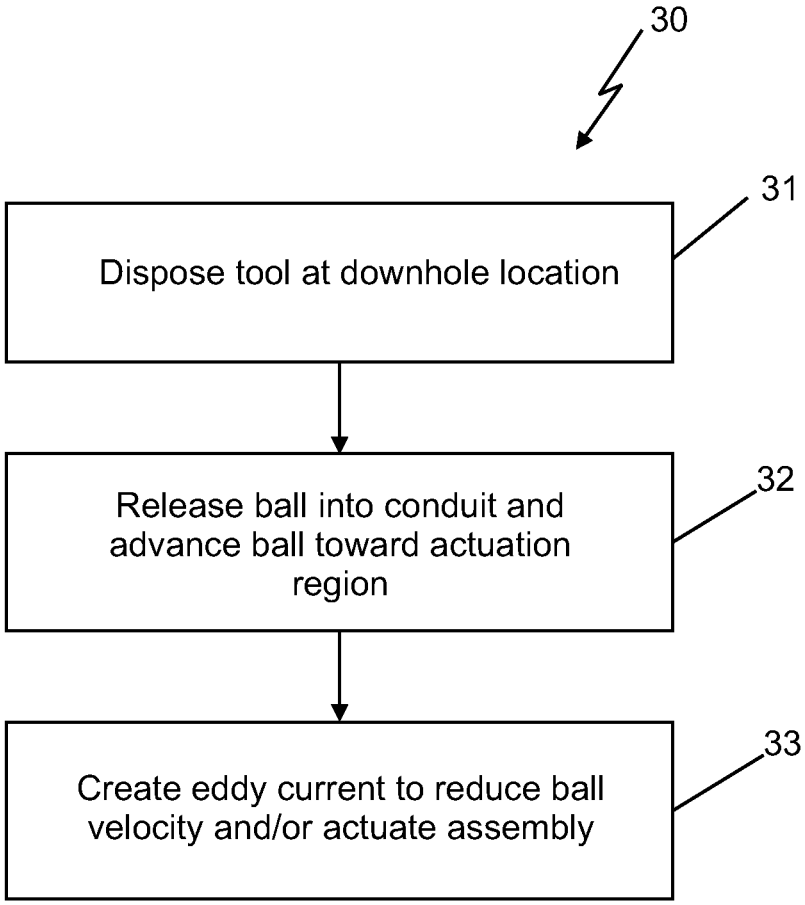
FIG. 4 is a flow diagram depicting a method of actuating an assembly.

Referring to FIGS. 2 and 3, in one embodiment, the actuation region 16 is incorporated in at least a portion of the housing 12 and/or is a movable component such as a sliding sleeve 24 for use, for example, as an actuator or valve. As shown in FIG. 2, the ball seat 22 may be configured to retain the ball 18 in a fixed position to fully or partially restrict fluid flow through the conduit 14, or may be configured to allow the ball 18 to contact the ball seat 22 and continue to move downstream after interacting with the ball seat 16 to, e.g., move an actuator. For example, the ball seat 22 may be a deformable or moveable component, such as a cantilever spring or an elastic member. The eddy currents created as the ball 18 advances through the actuation region 16 act to slow the ball 18 prior to impact with the ball seat or may cause the sliding sleeve 24 to move due to the force created between the ball 18 and the sliding sleeve 24. The actuation region 16 and/or sleeve 24 may be configured as desired to produce a desired distance between the ball 18 and the actuation region interior surface, so that the magnetic coupling strength can be increased or decreased as desired. For example, at least a portion of the actuation region 16 and/or sleeve 24 has a reduced inner cross-sectional area and/or diameter relative to other portions of the fluid conduit 14 that results in a region in which the annular distance between the interior surface and the ball 18 is reduced relative to the other portions. This reduced area and/or diameter portion extend along the entire conduit 14 or any portion thereof. As the magnetic coupling strength and braking effect increases as the distance between the ball 18 and the actuation region 16 decreases, the reduced portion experiences a greater braking effect and the annular distance can be reduced as desired to increase the braking effect or magnetic coupling strength.

In addition to, or in place of, causing actuation through physical interaction between the valve actuator and the valve seat carrier, the magnetic interaction of the ball 18 and the actuation region 16 or sliding sleeve 24 may be utilized to actuate the assembly. For example, the force generated by the opposing magnetic fields cause the sleeve 24 to move entirely or partially by magnetic coupling. This magnetic coupling could be used exclusively to actuate the assembly (as shown in FIG. 3), or may used in conjunction with a physical coupling between the ball 18 and the ball seat 22 (as shown in FIG. 2).

In one embodiment, actuation of the assembly is due at least partially to a force generated by creating a pressure differential in the conduit 14. For example, at least part of the actuation region 16 and/or sliding sleeve 24 has an inner diameter or inner cross-sectional area that is smaller than the inner diameter of the remainder of the carrier 12 and creates a local fluid restriction in the diameter or cross-sectional area of the conduit 14. When the magnetized ball 18 arrives in this restricted region, its velocity is impeded owing to the opposing magnetic field generated by the eddy currents in the sliding sleeve 24. As a result of the ball 18 slowing to a velocity less than the fluid flow rate, a pressure differential is created between regions immediately upstream and downstream from the ball 18. Force generated by the pressure differential is transferred to the valve seat 22 via shear force from the viscous downhole fluid.

Thus, in one embodiment, the actuation force is generated via magnetic coupling and/or a fluid pressure differential, and is thereby generated without requiring any mechanical contact between the ball 18 and the actuation region 16 or ball seat 22. Transfer of the actuating force can thus be affected without requiring an impact between the ball 18 and the ball seat 22. In addition, the assembly can be actuated without requiring that fluid flow be blocked, thereby reducing pressure surges that occur due to flow blockage.

An example of a ball seat assembly is described below. This example may be utilized in conjunction with the configurations shown in FIG. 2 or 3, but is not so limited. In this example, the ball 18 is an approximately 1.25 inch diameter NdFeB spherical magnet. The actuation region 16 and/or sleeve 24 is a conductive aluminum alloy sleeve having an inner diameter of approximately 1.5-2 inches. In another example, the ball 18 has a diameter of approximately 1.25 inches and the actuation region 16 and/or sleeve 24 has an inner diameter of approximately 1.27 inches. In place of or in addition to the sleeve 24, a ball seat 22 may be mounted on or otherwise attached to the sleeve 24 or the housing 12 and defines an inner diameter that is smaller than the sphere magnet's diameter (e.g., approximately one inch).

Although embodiments described herein include the ball 18 being configured to generate a magnetic field that is configured to induce or create eddy currents in an electrically conductive actuation region 16 or sleeve 24, the actuating devices and methods are not so limited. For example, the ball 18 is made at least partially of an electrically conductive material such as aluminum (e.g., an aluminum ball) and the actuation region 16 and/or sleeve 24 is configured to produce a magnetic field that can create eddy currents in the ball 18 as the ball 18 advances along the actuation region and produce the magnetic coupling and braking effects described herein. In other examples, the actuation region 16 and/or sleeve 24 is made of a magnetized material or includes one or more permanent magnets and/or electromagnets arrayed axially and/or circumferentially along the actuation region 16 and/or sleeve 24.

The downhole tool 10 is not limited to that described herein. The downhole tool 10 may include any tool, carrier or component that includes a ball seat assembly. The carriers described herein, such as a production string and a screen, are not limited to the specific embodiments disclosed herein. A "carrier" as described herein means any device, device component, combination of devices, media and/or member that may be used to convey, house, support or otherwise facilitate the use of another device, device component, combination of devices, media and/or member. Exemplary non-limiting carriers include borehole strings of the coiled tube type, of the jointed pipe type and any combination or portion thereof. Other carrier examples include casing pipes, wirelines, wireline sondes, slickline sondes, drop shots, downhole subs, bottom-hole assemblies, and drill strings. In addition, the downhole tool 10 is not limited to components configured for downhole use. As described herein, "axial" refers to a direction that is at least generally parallel to a central longitudinal axis of the conduit 14. "Radial" refers to a direction along a line that is orthogonal to the longitudinal axis and extends from the longitudinal axis. As described herein, "downstream" refers to the direction of movement of the ball and/or the downhole fluid, and "upstream" refers to a direction opposite the direction of movement of the ball and/or the downhole fluid.

FIG. 3 illustrates a method 30 of restricting fluid flow in a component. The method includes, for example, actuating a valve or packer in a downhole assembly. The method 30 includes one or more stages 31-33. Although the method is described in conjunction with the tool 10, the method can be utilized in conjunction with any device or system (configured for downhole or surface use) that utilizes a magnetically coupled ball-seat assembly.

In the first stage 31, in one embodiment, the tool 10 is disposed at a downhole location, via for example a borehole string or wireline. In the second stage 32, the ball 18 is released into the conduit 14, for example by dropping the ball 18 into the conduit 14 and/or pumping the ball 18 through the conduit 14. The ball 18 advances through the conduit toward the actuation region 16. In the third stage 33, the ball 18 advances along the actuation region 16 and the moving magnetic field created by the ball 18 creates an eddy current in the actuation region 16 that slows the ball 18 and/or actuates the assembly. In one embodiment, the actuation region 16 includes a ball seat 22, and the assembly is actuated by seating the ball 18 on the ball seat 22 and at least partially restricting fluid flow. In one embodiment, the actuation region 16 includes a moveable sleeve 24 that moves in response to contact between the ball 18 and the ball seat 22. In one embodiment, the actuation region 16 includes a moveable sleeve 24, which is actuated due to the magnetic coupling between the ball 18 and the sleeve 24. For example, the force created by the magnetic coupling and/or a pressure differential created by slowing the ball seat causes the sleeve 24 to move and actuate the assembly.

The systems and methods described herein provide various advantages over existing processing methods and devices. The embodiments described herein can significantly reduce surge pressure on the ball seat assembly by slowing the ball before contact with the ball seat, reducing impact and/or by actuating without blocking fluid flow. The net reduction in pressure surge on the ball-seat assembly can enable the use of a wider range of construction materials and reduce the complexity of ball-seat design, for example by reducing the need for relatively complex ball seat designs to reduce impact. In addition, the apparatuses can allow for the ball seat to have a larger inner diameter due to the reduced contact stress.

Furthermore, the systems and methods may be used as an actuator in which the actuation force can be transferred from the ball to the actuation sleeve without (or with a reduced) mechanical interaction between the ball and sleeve. Such configurations can avoid impacting a ball seat via mechanical interaction or reduce the impact, so that impact forces and pressure surges are reduced, and fluid flow can be maintained or at least not significantly reduced during actuation.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

The invention claimed is:

1. An actuator comprising:

a carrier including an axially elongated fluid conduit therein, the fluid conduit configured to receive a ball therein; and an axially elongated ball receiving element extending along the fluid conduit, wherein one of the ball and the ball receiving element is configured to produce a magnetic field, and another of the ball and the ball receiving element includes an electrically conductive material, the ball and the ball receiving element configured so that the ball is magnetically coupled to the ball receiving element so that the electrically conductive material is exposed to the magnetic field as the ball advances through the ball receiving element, and eddy currents are generated in the electrically conductive material that cause a repulsive force between the ball receiving element and the ball, the ball receiving element defining an elongated portion of the fluid conduit including a seating element disposed thereon, the elongated portion having a reduced diameter relative to adjacent portions of the fluid conduit, the reduced diameter defining a distance between the ball receiving element and the ball that results in a magnetic coupling strength sufficient to reduce a velocity of the ball as the ball advances through the ball receiving element relative to the velocity of the ball when the ball is in one of the adjacent portions.

2. The actuator of claim 1, wherein the ball is configured to produce the magnetic field and the axially elongated ball receiving element includes the electrically conductive material.

3. The actuator of claim 1, wherein the seating element is at least partially disposed within the fluid conduit, the at least one seating element configured to contact the ball and at least partially restrict fluid flow therethrough.

4. The actuator of claim 1, wherein the ball receiving element is axially moveable in response to the ball advancing through the ball receiving element.

5. The actuator of claim 4, wherein the ball receiving element is configured to move axially in response to the repulsive force to actuate the actuator.

6. The actuator of claim 4, wherein the ball receiving element has a reduced inner diameter relative to the fluid conduit.

7. The actuator of claim 6, wherein the repulsive force causes the velocity of the ball to slow relative to a fluid flow rate and create a pressure differential between a first fluid region upstream of the ball and a second fluid region downstream of the ball, the differential causing a force on the ball that is transferred to the at least one seating element to actuate the ball receiving element.

8. The actuator of claim 1, wherein the ball is configured to be at least one of dropped into and pumped through the fluid conduit.

9. The actuator of claim 1, wherein one of the ball and the ball receiving element includes at least one of a permanent magnet and an electromagnet.

10. The actuator of claim 1, wherein the carrier is configured to be disposed in a borehole in an earth formation.

11. A method of actuating, comprising:

releasing a ball into a fluid conduit in a carrier and receiving the ball in an axially elongated ball receiving element disposed at the fluid conduit, wherein one of the ball and the ball receiving element is configured to produce a magnetic field, and another of the ball and the ball receiving element includes an electrically conductive material, the ball receiving element defining an elongated portion of the fluid conduit including a seating element disposed thereon, the elongated portion having a reduced diameter relative to adjacent portions of the fluid conduit;

advancing the ball through the ball receiving element so that the electrically conductive material is exposed to the magnetic field as the ball advances through the ball receiving element; and magnetically coupling the ball and the ball receiving element by producing a repulsive force between the ball receiving element and the ball via eddy currents generated in the electrically conductive material, wherein the reduced diameter defines a distance between the ball receiving element and the ball that results in a magnetic coupling strength sufficient to reduce a velocity of the ball as the ball advances through the ball receiving element relative to the velocity of the ball when the ball is in one of the adjacent portions.

12. The method of claim 11, wherein the ball is configured to produce the magnetic field and the axially elongated ball receiving element includes the electrically conductive material.

13. The method of claim 11, further comprising actuating the ball receiving element by contacting the ball with the seating element.

14. The method of claim 13, wherein the actuation includes seating the ball on the seating element and at least partially restricting fluid flow therethrough.

15. The method of claim 13, further comprising actuating the ball receiving element by moving the ball receiving element in response to contacting the ball with the seating element.

16. The method of claim 11, wherein the ball receiving element is axially moveable.

17. The method of claim 16, wherein the repulsive force causes the velocity of the ball to slow relative to a fluid flow rate and create a pressure differential between a first fluid region upstream of the ball and a second fluid region downstream of the ball, the differential causing a force on the ball that is transferred to the at least one seating element to actuate the ball receiving element.

18. The method of claim 11, further comprising actuating the ball receiving element by axially moving the ball receiving element via the repulsive force in response to the ball advancing through the ball receiving element.

19. The method of claim 11, wherein actuation includes at least one of magnetically coupling the ball and the ball receiving element and causing a pressure differential to create a force that is transferred to the ball receiving element.

20. The method of claim 11, wherein releasing the ball includes at least one of dropping the ball into the fluid conduit and pumping the ball through the fluid conduit.

* * * * *